US006720722B2

(12) United States Patent
Mutso et al.

(10) Patent No.: US 6,720,722 B2
(45) Date of Patent: Apr. 13, 2004

(54) COLOR PICTURE TUBE HAVING A LOW EXPANSION TENSIONED MASK ATTACHED TO A HIGHER EXPANSION FRAME

(75) Inventors: Rein Roman Mutso, Lancaster, PA (US); Edward Richard Garrity, Jr., Lancaster, PA (US); Christopher Lee French, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 10/097,233

(22) Filed: Mar. 13, 2002

(65) Prior Publication Data

US 2003/0173887 A1 Sep. 18, 2003

(51) Int. Cl.[7] ..... H01J 29/80
(52) U.S. Cl. ..... 313/407; 313/408; 313/402
(58) Field of Search ..... 313/402, 407, 313/408, 403, 404, 405, 406

(56) References Cited

U.S. PATENT DOCUMENTS 4,751,424 A 6/1988 Tong ..... 313/402
4,754,188 A 6/1988 Watanabe et al. ..... 313/402
4,771,213 A 9/1988 Higashinakagawa et al. .... 313/402
4,929,864 A * 5/1990 Tong ..... 313/402
5,236,522 A 8/1993 Fukuda et al. ..... 148/336
5,605,582 A 2/1997 Inoue et al. ..... 148/320
6,512,326 B1 * 1/2003 Arai et al. ..... 313/407

* cited by examiner

*Primary Examiner*—Edward J. Glick
*Assistant Examiner*—Elizabeth Gemmell
(74) *Attorney, Agent, or Firm*—Joseph S. Tripoli; Carlos M. Herrera; Patricia A. Verlangieri

(57) ABSTRACT

A color picture tube having a tensioned mask supported by a frame mounted within the tube. The frame is constructed of a carbon steel material, and the mask is constructed of a nickel alloy material that expands substantially less per unit length than does the frame in the normal operating temperature range of the tube, and expands substantially the same per unit length as the frame in the higher thermal cycling temperature range used during tube processing.

10 Claims, 5 Drawing Sheets

COLOR PICTURE TUBE HAVING A LOW EXPANSION TENSIONED MASK ATTACHED TO A HIGHER EXPANSION FRAME

This invention relates to color picture tubes having tensioned masks, and particularly to a tube having means for connecting a tensioned mask, that is made of a material having a relatively low coefficient of thermal expansion material, to a support frame, that has a significantly higher coefficient of thermal expansion at normal operating temperature, but wherein the mask material has a coefficient of thermal expansion at high tube processing temperatures that is close to the coefficient of thermal expansion of the frame at the same processing temperatures.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tensioned mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tensioned mask tube if the required tension on the mask is reduced. One way to reduce the required mask tension is to make the mask from a material having a low coefficient of thermal expansion. However, a mask from such material would require a support frame of a material having a similar coefficient of thermal expansion, to prevent any mismatch of expansions during thermal processing that is required for tube manufacturing, and during tube operation. Because the metal materials that have low coefficients of thermal expansion, such as INVAR® (nickel-iron alloy), are relatively expensive, it is rather costly to make both the mask and frame out of identical or similar low expansion materials. Therefore, it is desirable to use the combination of a low expansion tensioned mask with a less expensive higher expansion support frame. However, such a mismatch in thermal expansion coefficients requires a solution to the problem that exists when there is a substantial mismatch in coefficients of thermal expansion between a tensioned mask and its support frame. Although there have been many suggested solutions to this mismatch, those solutions have proven to be either difficult to achieve or quite expensive. Therefore, there is still a need for other solutions to the mask and frame materials selections.

SUMMARY OF THE INVENTION

The present invention provides an improvement in a color picture tube having a tensioned mask supported by a frame mounted within the tube. The frame is constructed of a carbon or low alloy steel material, and mask is constructed of a nickel alloy material that expands substantially less per unit length than does the frame in the normal operating temperature range of said tube, and expands substantially the same per unit length as said frame in the higher thermal cycling temperature range used during of tube processing.

DETAILED DESCRIPTION OF THE PREFERRED EMBODIMENTS

Figure 1:
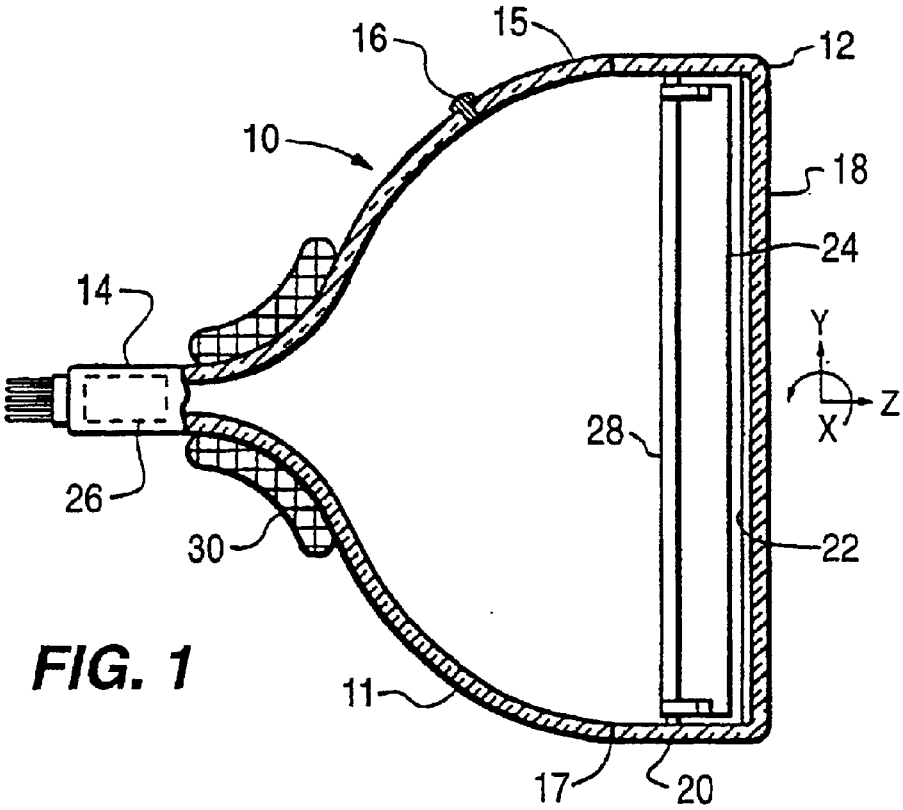
FIG. 1 is a side view, partly in axial section, of a color picture tube embodying the invention.

FIG. 1 shows a color picture tube 10 having a glass envelope 11 comprising a rectangular faceplate panel 12 and a tubular neck 14 connected by a funnel 15. The funnel 15 has an internal conductive coating (not shown) that extends from an anode button 16 toward the panel 12 and to the neck 14. The panel 12 comprises a substantially cylindrical viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tensioned mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
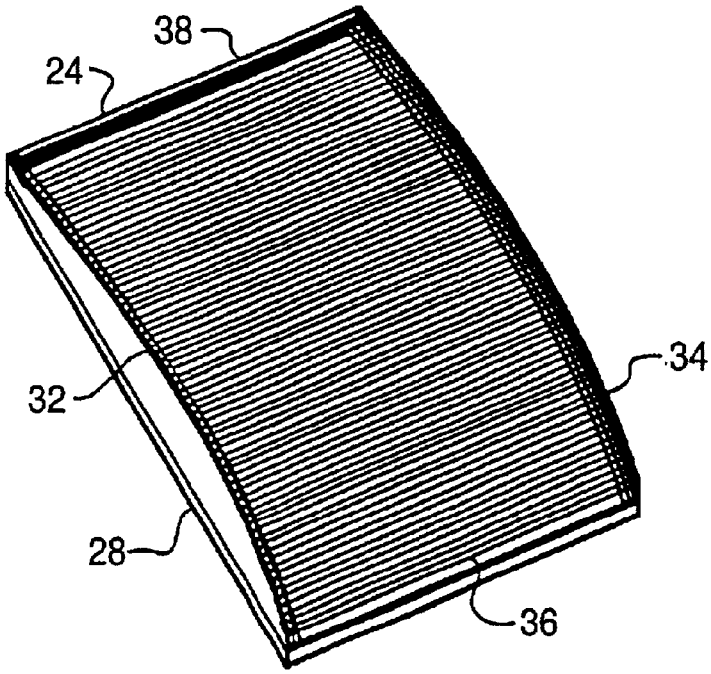
FIG. 2 is a perspective view of a tension mask-frame assembly.
Figure 3:
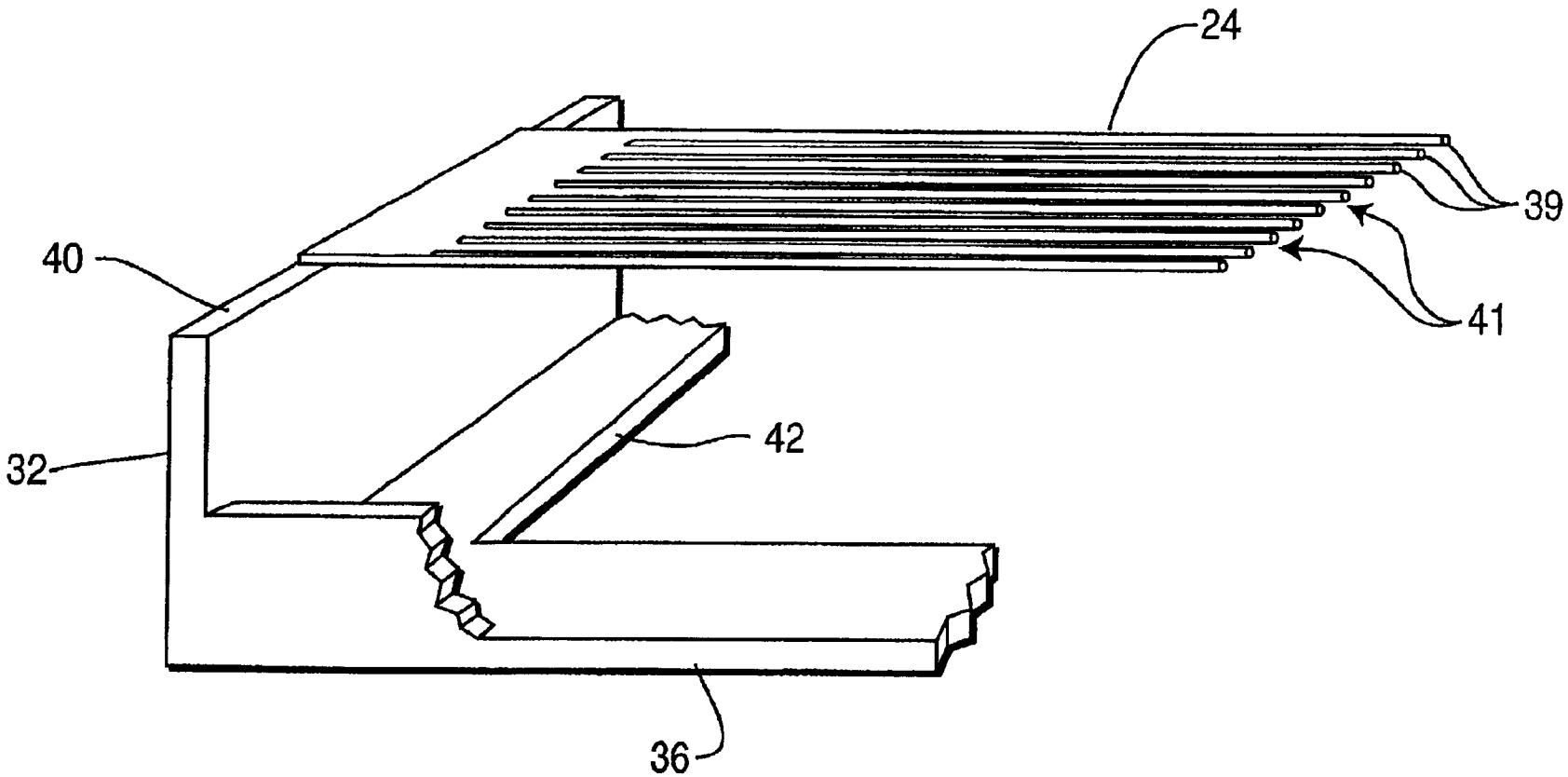
FIG. 3 is a partial perspective view of the mask-frame assembly of FIG. 2.

The tensioned mask 24, as shown in FIGS. 2 and 3, is attached to a peripheral frame 28 that includes two long sides 32 and 34, and two short sides 36 and 38. The two long sides 32 and 34 of the frame parallel a central major axis, X, of the tube; and the two short sides 36 and 38 parallel a central minor axis, Y, of the tube. The tensioned mask 24 includes an apertured portion that contains a plurality of metal strips 39 having a multiplicity of elongated slits 41 therebetween that parallel the minor axis of the mask. Each slit 41 extends between the two long sides 32 and 34 of the mask 24.

As shown in greater detail in FIG. 3, each of the two long sides 32 and 34 (not shown) of the frame 28 is formed by two perpendicular flanges 40 and 42, that are arranged in an L-shaped cross-section. The flange 40, to which the mask 24 is attached, may vary in height from the center of each section longitudinally to the ends of the sections to permit the best tension compliance over the mask. Each of the short sides 36 and 38 (not shown) has an L-shaped cross-section upper portion 44. Although the frame of the preferred embodiment is shown having L-shaped cross-sections, other frame designs are also may be used with the present invention, such as those using tubes and cantilevers or other structures to maintain the strength needed for a tension mask.

Figure 4:
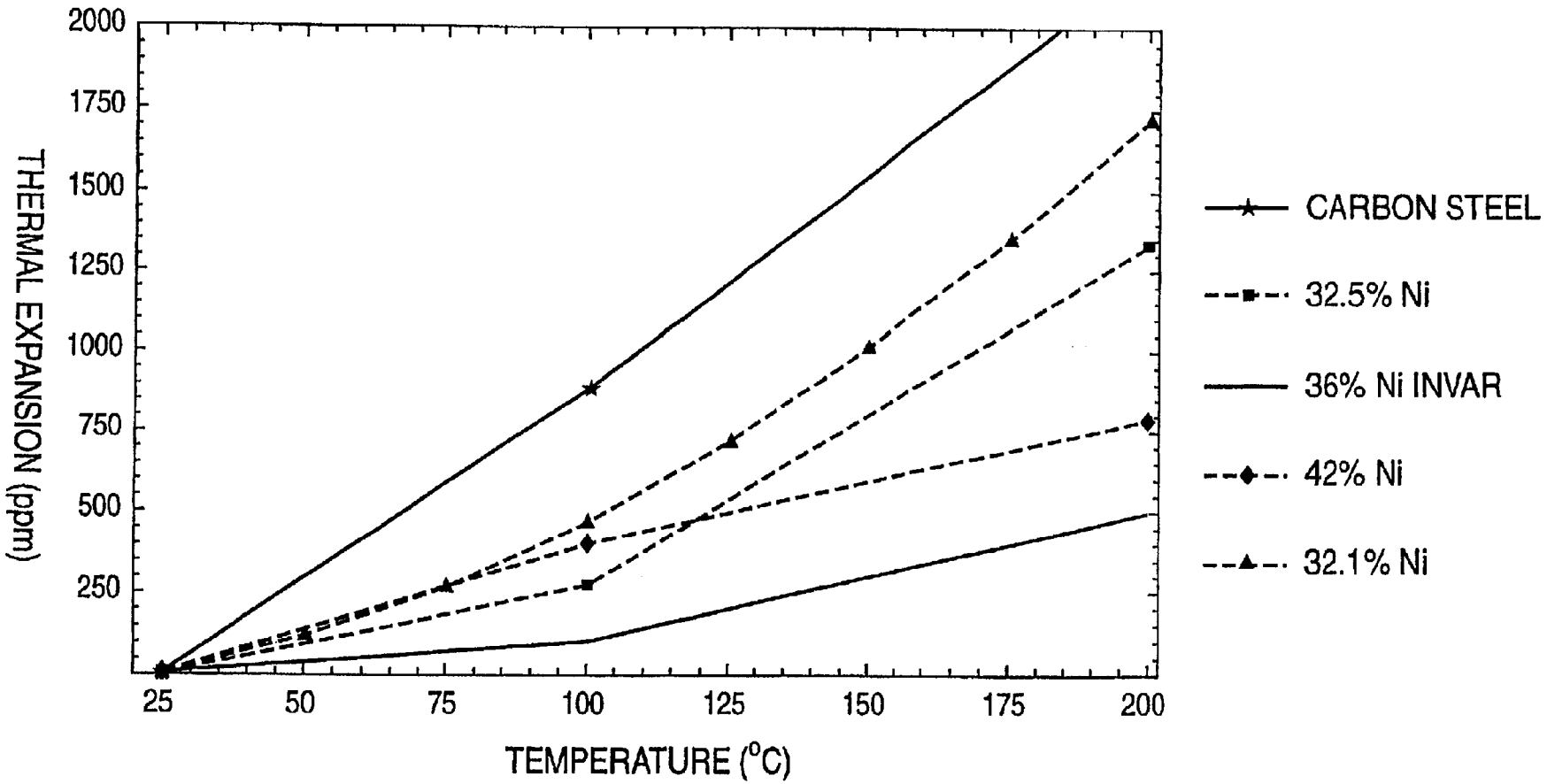
FIG. 4 is a graph showing the thermal expansion of five materials in the normal tube operation temperature range.

A key factor in the present invention is the selection of materials for the mask and frame. Such selection requires a careful analysis of the relations of the materials to each other in order to obtain the best combination at reasonable cost. The graph of FIG. 4 shows a comparison of the thermal expansions of four nickel alloys and carbon steel within the range (25° C. to 120° C.) of tube operation. It can be seen that 36% Ni INVAR® (nickel-iron alloy) has the lowest amount of expansion within this normal operating range, and that the 32.5% Ni alloy has an expansion that is closer to that of INVAR® (nickel-iron alloy) than do the other two nickel alloys (32.1% and 42%) shown.

Figure 5:
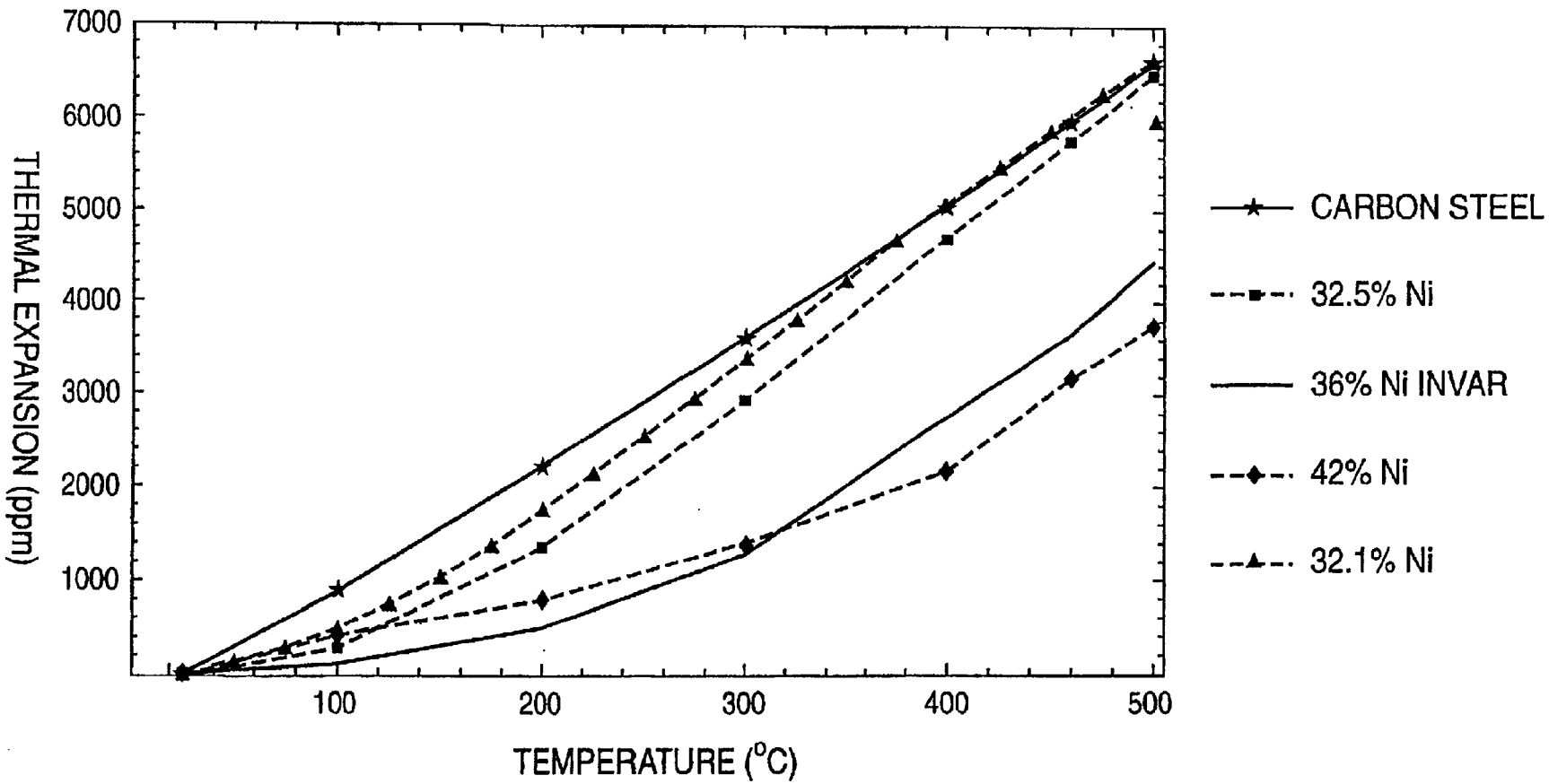
FIG. 5 is a graph showing the thermal expansion of five materials in the tube processing temperature range.

The graph of FIG. 5 expands the area of the graph of FIG. 4 to show a comparison of the thermal expansions of the same four nickel alloys and carbon steel within a broader temperature range that includes a typical tube processing temperature range of 410° C. to 500° C. It can be seen that the expansions of both the 32.5% Ni and 32.1% Ni alloys are very close to that of the carbon steel in the tube processing range, whereas the expansions of the 42% Ni alloy and the 36% INVAR® (nickel-iron alloy) differ greatly from the expansion of the carbon steel in this processing range.

From the analysis, it is found that the 32.5% Ni alloy, by its thermal expansion behavior, almost matches the best characteristics of INVAR® (36% Ni alloy) in the normal operating range, thereby providing low expansions in this normal operating range. However, in the range of the thermal processing range, where a great expansion mismatch occurs with an INVAR® (nickel-iron alloy) mask and steel frame combination, the expansion of a 32.1% Ni alloy mask nearly matches the expansion of a carbon steel frame and that the expansion of the 32.5% Ni alloy is very close to the carbon steel expansion. From this analysis, it was determined that the 32.5% Ni alloy provides the best material for a tension mask used with a carbon steel frame, but that other mask alloys within a range of 31% Ni to 33% Ni could provide adequate compliance between mask and steel frame, while also providing adequate thermal expansion control.

Figure 6:
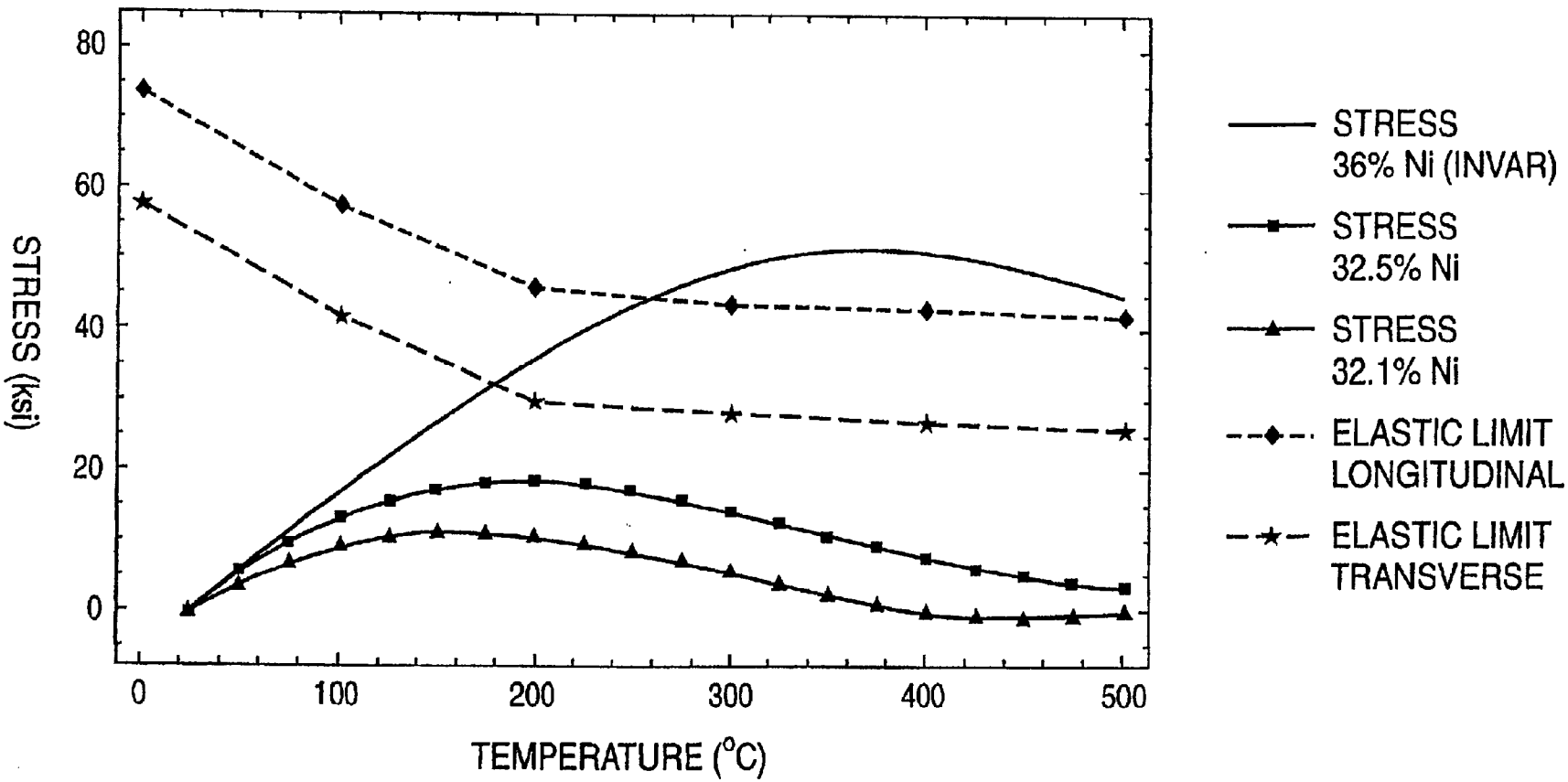
FIG. 6 is a graph showing thermal stress versus temperature for three different Fe—Ni materials, and showing the elastic limit for an iron-nickel alloy both longitudinally and transversely to the rolling direction of an iron-nickel alloy sheet.

The graph of FIG. 6 shows a comparison of the stress produced in a tensioned mask made from alloys with 36% Ni (INVAR®), 32.1% Ni, and 32.5% that were attached to a rigid steel frame, as well as the elastic limits, transverse and longitudinal to the direction of rolling of a typical cold rolled iron-nickel alloy with the same composition range, when the mask frame assembly is held at temperatures between 25° C. and 500° C.

The maximum stress produced in the 32.5% Ni alloy is below 20 ksi, occurring at about 200° C. and the maximum stress produced in the 32.1% Ni alloy is about 10 ksi, occurring at about 150° C.; both of the maximum stress levels are lower than the elastic limit of the indicated alloy at any temperature, whereas the 36% Ni alloy (INVAR®) shows a maximum stress of 50 ksi at about 380° C., which is above the elastic limit of the material over a wide temperature range.

If the stress in the sample exceeds the elastic limit, the elongation transitions from elastic deformation into the plastic deformation regime and will fail to return to its original shape. For a tensioned mask, this will cause piling or wrinkling upon return to room temperature from the high temperature processing conditions. Some benefits of the preferred embodiments are: (1) mask border deformation does not occur, thereby suppressing wrinkles in the horizontal direction, and (2) minimum creep in the strand length is realized, thereby preserving tension in the vertical direction.

It is generally preferred to use a frame of a first material having a first average coefficient of thermal expansion at a first temperature and a second average coefficient of thermal expansion at a second temperature. The second temperature is substantially higher than the first temperature. With such a frame the mask is of a second material having a third average coefficient of thermal expansion at the first temperature that is substantially less than is the first average coefficient of the first material (e.g., about 25% to 50% less). The second material has a fourth average coefficient of thermal expansion at the second temperature that is relatively close to the second average coefficient of the first material (e.g., within about 95% to 105%). In one embodiment, the first average coefficient of thermal expansion is approximately $12\times10^{-6}$ m/m/K, the second average coefficient of thermal expansion is approximately $14\times10^{-6}$ m/m/K, the third average coefficient of thermal expansion is approximately 3 to $6\times10^{-6}$ m/m/K and the fourth average coefficient of thermal expansion is approximately $14\times10^{-6}$ m/m/K.

In another preferred embodiment, the four sides of the frame have L-shaped cross-sections, preferably of 4130 steel having a wall thickness of 0.175 cm. The 4130 steel is an alloy steel. Alloy steel, as used herein, includes: low-alloy steel, which has an alloy content of less than or equal to 8% and high-strength low-alloys, which is a variation from low-alloy steel. Carbon steel is a steel that has no specific minimum quantity for any alloying element, other than the commonly accepted amounts of manganese, silicon, copper and containing only an incidental amount of other elements. Although the frame sides have been shown as having an L-shaped cross-section, C-shaped, triangular-shaped, or rectangular-shaped cross-sections, are also possible. The mask in this preferred embodiment is of a 32.5% nickel-iron alloy, such as Carpenter Temperature Compensator "32" from Carpenter Technology Corporation, which has the following constituents: carbon 0.12%, manganese 0.60%, silicon 0.25%, nickel 32.5% and the balance iron.

What is claimed is:

1. A color picture tube having a tensioned mask supported by a support frame mounted within said tube, including said frame constructed of a carbon or alloy steel, and said mask being of a nickel alloy that expands substantially less per unit length than does said frame in the normal operating temperature range of said tube, and expands substantially the same per unit length as said frame in the higher thermal cycling temperature range used during tube processing.

2. The tube as defined in claim 1, wherein said nickel alloy has a nickel content of 32.5±0.5%.

3. The tube as defined in claim 1, wherein the normal operating temperature range of said tube is 25° C. to 120° C. degrees centigrade and the thermal cycling temperature range of said tube during tube processing is 410° C. to 500° C.

4. A color picture tube having a tensioned mask supported by a support frame mounted within said tube, including said frame being of a first material having a first average coefficient of thermal expansion at a first temperature and a second average coefficient of thermal expansion at a second temperature, said second temperature being substantially higher than said first temperature, and said mask being of a second material having a third average coefficient of thermal expansion at said first temperature that is substantially less than is said first average coefficient of said first material, and said second material having a fourth average coefficient of thermal expansion at said second temperature that is relatively close to said second average coefficient of said first material.

5. The tube as defined in claim 4 wherein said third average coefficient is about 25 to 50% that of the first average coefficient and said fourth average coefficient is about 95% to 105% that of said second average coefficient.

6. The tube as defined in claim 4 wherein said first average coefficient of thermal expansion is approximately $12\times10^{-6}$ m/m/K, said second average coefficient of thermal expansion is approximately $14\times10^{-6}$ m/m/K, said third average coefficient of thermal expansion is approximately 3 to $6\times10^{-6}$ m/m/K and said fourth average coefficient of thermal expansion is approximately $14\times10^{-6}$ m/m/K.

7. A color picture tube having a tensioned mask supported by a frame mounted within said tube, including said frame being constructed of carbon or alloy steel, and said mask being constructed of a nickel alloy having a nickel content of from about 32% to about 33%.

8. The tube as defined in claim 7, wherein the nickel content of the mask material is about 32.5%.

9. A color picture tube comprising:

a screen formed on an inner surface of the color picture tube;

a frame constructed of a carbon or alloy steel removably mounted in a spaced relationship to said screen;

a tensioned mask supported by said frame, said mask being constructed of a nickel alloy that expands substantially less per unit length than does said frame in the normal operating temperature range of said tube, and expands substantially the same per unit length as said frame in the higher thermal cycling temperature range used during tube processing.

10. A color picture tube having a tensioned mask attached to a frame mounted within said tube, including said frame being constructed of carbon or alloy steel, and said mask being constructed of a nickel alloy having a composition providing thermal expansion of said mask between 25° C. and 500° C. such that stress produced in the mask by the frame does not exceed the elastic limit of the mask.

* * * * *